US005348610A

United States Patent [19]

McKinlay et al.

[11] Patent Number: 5,348,610

[45] Date of Patent: Sep. 20, 1994

[54] APPARATUS FOR MANUFACTURING CORRUGATED BOARD

[75] Inventors: Peter R. McKinlay, Doncaster; Neil W. Shaw, Ivanhoe, both of Australia

[73] Assignee: Amcor Limited, South Melbourne, Australia

[21] Appl. No.: 90,412

[22] Filed: Jul. 12, 1993

Related U.S. Application Data

[63] Continuation-in-part of Ser. No. 585,091, Oct. 31, 1990, abandoned.

[30] Foreign Application Priority Data

Mar. 31, 1988 [AU] Australia ..... PI7541
Apr. 22, 1988 [AU] Australia ..... PI7878

[51] Int. Cl.[5] ..... B31F 1/28

[52] U.S. Cl. ..... 156/472; 156/471; 156/205; 156/210

[58] Field of Search ..... 156/470, 471, 472, 473, 156/292, 210, 205, 208; 493/463

[56] References Cited

U.S. PATENT DOCUMENTS 2,589,966 3/1952 Rullo ..... 156/472 X
3,700,518 10/1972 Ohmori ..... 156/292 X
4,814,038 3/1989 Hayashi et al. ..... 156/472 X
4,886,563 12/1989 Bennett et al. ..... 156/292 X

FOREIGN PATENT DOCUMENTS 901255 1/1954 Fed. Rep. of Germany ..... 156/472

*Primary Examiner*—Michael W. Ball
*Assistant Examiner*—Michele K. Yoder
*Attorney, Agent, or Firm*—Bucknam and Archer

[57] ABSTRACT

An apparatus for making a single face corrugated board having two fluted mediums bonded together at the flute tips has (a) mill roll stands for two mediums and one liner; (b) a carrier roll fluted to support a first fluted medium; (c) a single corrugating roll of diameter not larger than the carrier roll engaging with the carrier roll to corrugate the first fluted medium; (d) a pair of corrugating rolls of diameter no larger than the carrier roll adapted to produce a second fluted medium, the pair being located and driven relative to the carrier roll to enable the first and second fluted mediums to be brought into flute tip to flute tip contact and to be conveyed by the carrier roll, the axes of the corrugating rolls not lying in a plane common with the single corrugating roll or the carrier roll; (e) a first adhesive application station to apply adhesive to one of the fluted mediums prior to the flute tips of the first and second fluted mediums coming into contact; (f) a second adhesive application station to apply adhesive to the exposed flute tips of the bonded mediums or to a liner board; (g) a liner applicator roll located adjacent to the carrier roll downstream of the second adhesive applicator positioned to lead a liner board into contact with the bonded fluted mediums without application of pressure; and (h) an energy radiator unit located adjacent the carrier roll downsteam of the liner applicator to accelerate curing of the adhesive bond between the liner and the mediums.

2 Claims, 4 Drawing Sheets

APPARATUS FOR MANUFACTURING CORRUGATED BOARD

CROSS-REFERENCES TO RELATED APPLICATIONS

This application is a continuation-in-part of U.S. Ser. No. 07/585,091, filed Oct. 31, 1990 now abandoned.

BACKGROUND OF THE INVENTION

This invention relates to a method of forming sandwich structures, comprising one or more non-corrugated sheet elements (liners) to which are bonded on e or two corrugated (fluted) sheet elements (mediums) which are themselves bonded together.

U.S. Pat. No. 4,886,563 discloses an improved corrugated paper board structure in which two layers of corrugated medium (flutes) are bonded together at the peaks of the flutes, and are sandwiched between two outer liners. The disclosures of U.S. Pat. No. 4,886,563 are incorporated herein by reference.

U.S. Pat. No. 4,886,563 also discloses a method of forming the structural paper in which two separate layers of corrugating medium are corrugated and then brought into flute tip to flute tip contact on synchronised corrugating rollers.

U.S. Pat. No. 3,700,518 disclosed a method of forming board having two outer liners and two inner fluted mediums bonded at their flute peaks. The method adopted is to corrugate two mediums together, bond liners to each separate the two single faced boards and adhere the boards together at the flute peaks of the fluted mediums. This method has the disadvantage of not being able to accurately bond the flute peaks together with pressure.

Australian Pat. No. Application 11926/88 addressed the problem of capital cost in constructing a new corrugating plant for the flute tip to flute tip paper board. As such, specification 11962/88 focused on a modification to existing corrugating machinery which enabled conventional corrugated board, as well as the new flute tip to flute tip corrugated board to be made.

Conventional machinery for forming corrugated board incorporates a unit for making single faced corrugated board, (a liner adhered to a single fluted layer). More complex board constructions can be formed by bonding the exposed flutes to another liner and, if desired, subsequently bonding that to another single faced corrugated board.

A "single facer" plant normally includes as its essential components:

(a) Mill roll stands for liner and corrugating medium.
(b) A pair of corrugating rollers for corrugating the medium into a fluted medium.
(c) A pair of heated smooth (non corrugated) guide rolls for the liner board.
(d) A non corrugated pressure roll for bringing the liner into contact with the second corrugating roller to form the single faced board.
(e) An idler roll to guide the formed single faced board to subsequent processing units.

With conventional single faced board a degree of pressure is applied to ensure secure bonding between the liner and the corrugated medium. This application of pressure creates pressure lines on the outer face of the liner corresponding to the position of the flute tips. The need to apply pressure can adversely affect the strength of the single faced structure and adversely affects the appearance of the board and its suitability for printing.

SUMMARY OF THE INVENTION

This invention has as its object the manufacture of new corrugated machinery to produce the improved corrugated paperboard structure in which one or two layers of corrugated medium (flutes) are precisely bonded together at the peaks of the flutes and are sandwiched between two outer liners. This is the primary purpose of this machinery. It is also a secondary object to produce a conventional single faced board without using any pressure to secure the bonding of the liner to the corrugated medium.

To this end the invention provides a single face corrugated board making apparatus capable of forming corrugated boards having two fluted mediums bonded together at the flute tips comprising:

(a) mill roll stands for two mediums and one liner;
(b) a carrier roll fluted to support a first fluted medium;
(c) a single corrugating roll of diameter no larger than the carrier roll engaging with the carrier roll to corrugate the first fluted medium;
(d) a pair of corrugating rolls of diameter no larger than the carrier roll adapted to produce a second fluted medium said pair being located and driven relative to the carrier roll to enable the first and second fluted mediums to be brought into flute tip to flute tip contact and to be conveyed by the carrier roll, the axes of the corrugating rolls not lying in a plane common with the single corrugating roll or the carrier roll;
(e) a first adhesive application station to apply adhesive to one of said fluted mediums prior to the flute tips of the said first and second fluted mediums coming into contact
(f) a second adhesive application station to apply adhesive to the exposed flute tips of the bonded mediums or to a liner board;
(g) a liner applicator roll located adjacent to said carrier roll downstream of said second adhesive applicator positioned to lead a liner board into contact with the bonded fluted mediums without application of pressure;
(h) an energy radiator unit located adjacent said carrier roll downstream of said liner applicator to accelerate curing of the adhesive bond between the liner and the mediums;
(i) the diameter of said carrier roll and the positioning of said pair of corrugating rolls being arranged to ensure there is sufficient remaining circumference on said carrier roll to enable the fluted mediums to be retained until after they have passed the curing zone of the said energy radiator.

The carrier roll is involved in every operation of the machine and is the key to ensuring retention of the product and precision of location of the mediums relative to each other. Although it is preferred to use a carrier roll of larger diameter than the other three corrugating rolls, it is quite acceptable to use corrugating and carrier rolls of the same diameter. To provide added rigidity along the length of the vacuum rolls they are preferably gun barrel bored.

The single corrugating roll is precisely located relative to the flutes on the carrier roll and is so loaded against the carrier roll to produce the first corrugated medium. To provide rigidity of the rolls and precision of flute tip to flute tip contact along the length of the rolls it is preferred to use co-operating end gears as disclosed in PCT AU92/00486. These are preferably located at either end of the carrier roll and the corrugating roll carrying the second fluted medium.

The first corrugated medium is held within the grooves of the carrier roll in which it was formed preferably by the use of vacuum in the carrier roll. The vacuum can be applied from within the carrier roll or externally to the grooves on the surface of the carrier roll. Alternatively positive air pressure can be applied externally to press the medium onto the carrier roll. It is also preferred that the carrier roll is arranged to have controlled camber on its surface in the axial direction at the point of contact of the corrugating roll and the carrier roll. Controlled camber rolls are commonly used on paper making machines in the paper industry.

The second fluted medium is corrugated in a pair of fairly conventional corrugating rolls, one loaded against the other. The inner roll of this pair of corrugating rolls is precisely located relative to the flutes on the carrier roll to ensure that the first and second mediums are brought together tip to tip, with great precision preferably using end gears. The pair of corrugating rolls, as a pair are loaded against the carrier roll to give the flute tip to flute tip pressure bond.

An additional controlled camber on the carrier roll surface in an axial direction can be provided at the point of contact between the inner corrugating roll and the carrier roll.

In constructing a 5 roll machine for making double fluted board according to U.S. Pat. No. 4,886,563 it was thought essential to keep the axes of the corrugating rolls in a single plane. In this invention it is not necessary for the axes of the 4 corrugating rolls (including the carrier roll) to be in a single plane.

It is not essential for the flute mediums to have the same pitch as long as a sufficient number of flute tips of each medium can be aligned. For example the machine of this invention can be used to make corrugated structural panel comprising a flat sheet and a first and second corrugated element wherein said first corrugated element is attached to said flat sheet, said second corrugated element has fewer flutes per meter than said first element, said second element having flutes of greater height than the flutes of said first element and the flute peaks of said second element being attached to alternate flute peaks of said first element. Preferably, in this embodiment, one of the corrugated mediums has half as many flutes per meter as the other medium with flutes two (2) times as high as those of the other medium.

Conventional heated "S" wrap liner applicator and drive rolls are preferably positioned to allow tangential approach of the liner prior to bonding to the flute to flute structure. Preferably the liner will run over an adjustable wrap preheater drum before the tension is controlled by the "S" wrap rolls.

Very similar treatment is preferably provided for each of the mediums prior to corrugating. This includes the provision of tension control, preheater/preconditioners, heated "S" wrap drive rolls and steam box conditioners.

The improved strength characteristics of the double flute construction enable lighter weight board to be made having strengths equivalent to those found in heavier boards of conventional structure. Thus savings in material costs are possible using the flute construction.

It has been found that boxes formed from flute to flute board exhibit superior durability and strength. The creasing and folding characteristics of board having flute to flute bonding are such that the corner and edge folds of boxes provide added strength to the construction. The flute to flute structure creases in a well defined manner to produce a hinged joint which is superior in strength, flexibility and visual appearance compared with creases in conventional board.

Bonded fluted mediums according to this invention can be subsequently bonded to any suitable liner material to form light weight structural laminates. The mediums can be manufactured from 100% cellulose fibre or ligno-cellulose fibre or combinations of cellulose, ligno-cellulose and synthetic fibres, or they may be laminated structures.

The liners or sheet elements may be of any material and structure of varying thickness including, but not limited to, paper board made of cellulose fibres, ligno-cellulose fibres, cellulose, ligno-cellulose and/or synthetic fibre mixtures; natural or synthetic polymers, wood, or metal; or laminates made of bonded layers of any combinations of these materials. Strips or strings of any material may also be fed intermittently, between the mediums across the flutes and thus be bonded at the flute tip to flute tip junction. The inclusion of such strips or strings will constrain the bonded mediums and prohibit expansion of the flute tip to flute tip structure until one or more liners are added and may additionally confer added strength to the board.

Bonding may be achieved by use of adhesives or by other means such as, but not limited to, soldering, brazing and fusion welding.

Where a light weight structural panel for building is required, such as ceiling panels or for use in furniture, the liners can be wood veneer. In other applications such as air-frame skins for aircraft, the liners may be metal foil or synthetic polymers.

The introduction of a machine of this type into a conventional corrugater line, enables the elimination of the need for pressure application to secure the bond between the liner and corrugating medium. This innovation allows the existing line to be used fully and in addition has the advantage of not adversely affecting the strength of the board and of not adversely affecting the appearance of the board by the presence of pressure lines.

BRIEF DESCRIPTION OF THE DRAWINGS

A preferred embodiment of this invention will now be described with reference to the drawings in which.

DESCRIPTION OF THE PREFERRED EMBODIMENTS

Figure 1:
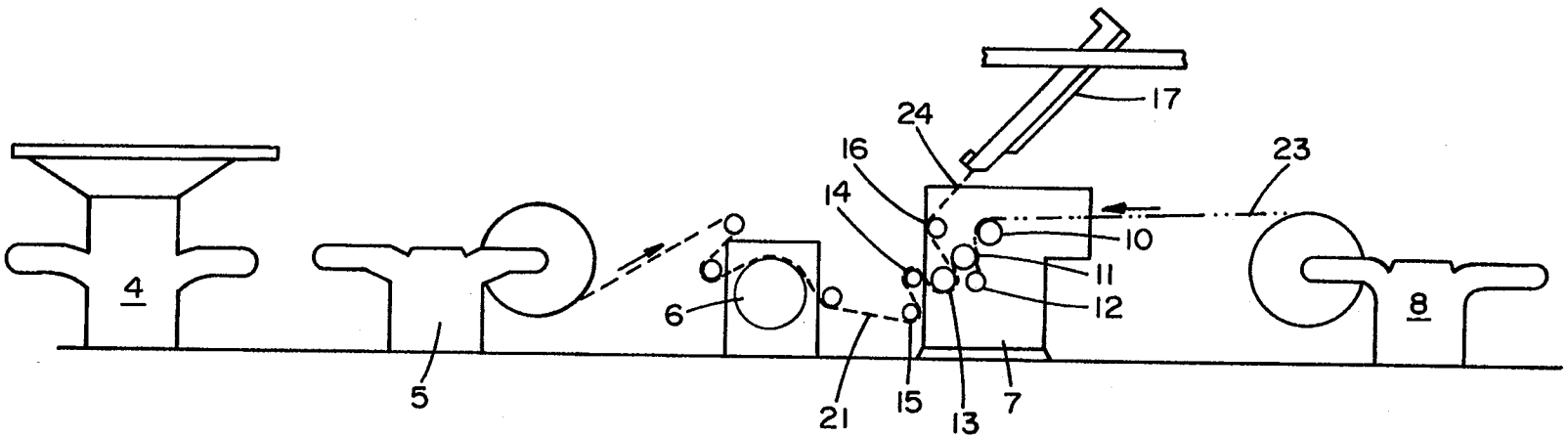
FIG. 1 represents a schematic view of a conventional single facer unit.

In FIG. 1, the conventional single facer unit includes mill roll stand 5, a preheater roll 6, a single facer station 7 and a mill roll stand 8 for the fluting medium.

The single facer station 7 comprises the corrugating rolls 10 and 11, adhesive applicator 12, pressure roll 13 for pressing the liner against the corrugate medium 23 on roll 11. The liner board 21 is fed from stand 5 over preheater roll 6 to the heated smooth guide rolls 14 and 15.

The formed single faced board 24 is transferred to idler roll 16 and then to conveyor 17 which transports the single faced board 24 for further processing.

Figure 2:
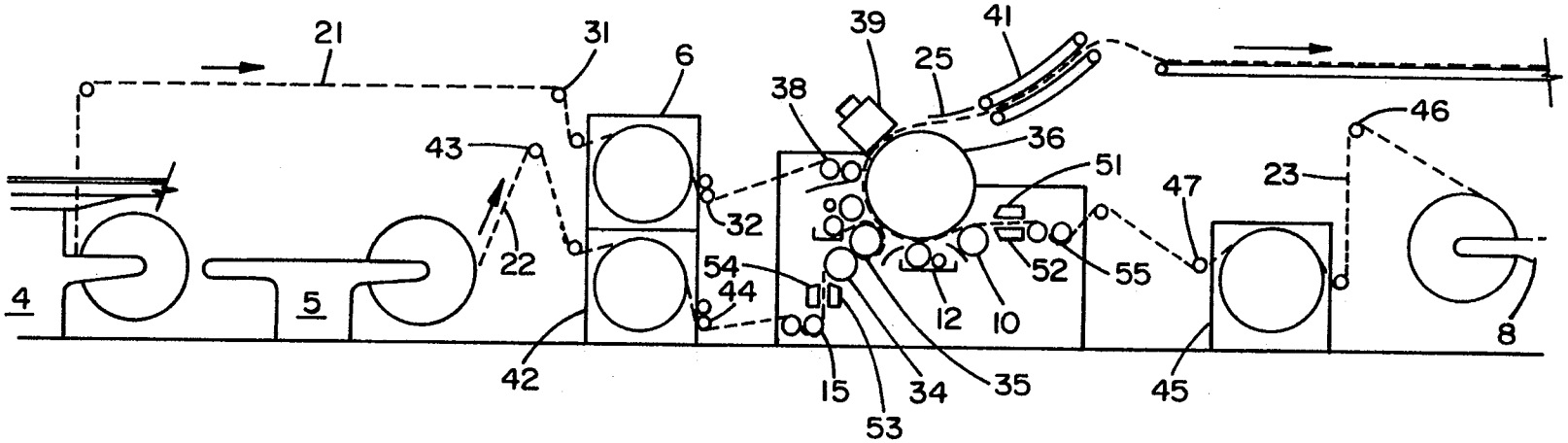
FIG. 2 shows a schematic view of the unit as described as this invention for forming a flute to flute structure.
Figure 3:
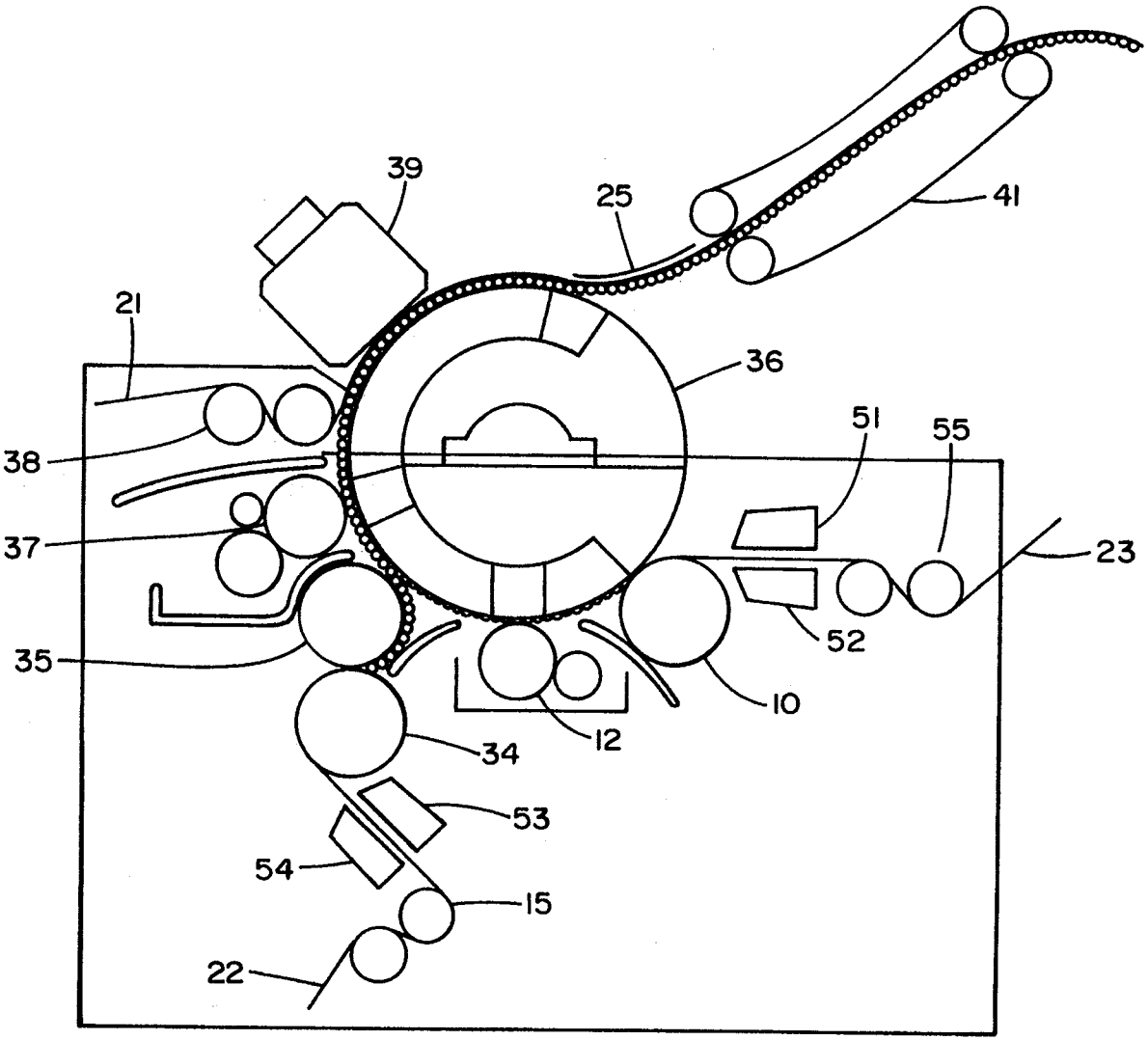
FIG. 3 shows a detailed view of FIG. 2

The present invention is exemplified in FIGS. 2 and 3 for manufacture of board when two fluted mediums are adhered at their flute peaks.

The two corrugating mediums 22 and 23 from mill back stands 5 and 8 are preconditioned by preconditioners 42 and 45. The driven "S" wrap rolls 15 and 55 feed the corrugating mediums into the corrugating nips. Steam boxes 51, 52 and 53, 54 further condition the mediums before they enter the nips.

Guide rolls 31, 32, 43, 44, 46 and 47 are located to guide the liner and mediums to and from the respective items of equipment.

The first corrugating medium 23 is fluted between corrugating roll 10 and the carrier roll 36. These rolls are ground with the same flute form or a flute form of ½ or double pitch as are corrugating rolls 34 and 35. The carrier roll in this embodiment is suitably of 900 mm diameter and the corrugating rolls are of 300 mm diameter.

As an alternative to applying vacuum, guides or fingers could be used to retain the first medium and then the flute to flute structure in the flutes of the carrier roll. Also as mentioned previously externally applied vacuum to the flutes of the carrier roll or positive air pressure to the fluted mediums will serve to maintain the fluted medium in the grooves of the carrier roll.

An adhesive applicator station 12 is located after corrugator roll 10 to apply adhesive to the flute tips of the first medium 23.

The corrugating medium 22 is fluted between corrugating rolls 34 and 35.

Roll 35 is provided with positive pressure at the point of discharge of the corrugated medium to assist in its release from the roll and bonding of the tip to tip flutes.

Corrugating roll 35 can be arranged with a vacuum facility to hold the fluted product in the roll flutes. As an alternative, guides or fingers may also be provided to achieve the positioning of the second medium as it contacts the first medium on the carrier roll.

The two corrugated mediums 22 and 23 are adhered together between rolls 35 and 36 which are driven synchronously to ensure precise flute tip to flute tip bonding. This can be achieved by installing a direct drive, meshed gear drive or toothed belt drive between the driven lower corrugating roll 35 and the carrier roll 36. Two camber elements to control the camber of roller 36 can be incorporated in the roll 36. The incorporation of camber control elements in carrier roll 36 will probably result in the removal of portion of the heating means from the carrier roll and the heating of the fluted mediums will be controlled largely by heating the corrugating rolls.

"S" wrap rolls 38 guide the liner 21 after preheater 6 to join with the flute to flute structure to form one particular example of the structures which are the subject of the invention disclosed in U.S. Pat. No. 4,886,563. The liner lead roll in the "S" wrap rolls 38 is positioned so that liner 21 moves along a line tangential to both the liner lead roll and the outer surface of the bonded mediums.

The top liner 21 is assisted in bonding to the flute to flute structure after the glue application by an input of energy in the form of radiant or convected heat, microwave or other energy by the units 39.

All components may be pre-heated, moistened or pre-treated to accelerate bonding of the component to component interfaces.

The carrier roll may be assisted in discharging the product by positive air pressure from blow box 40 inside the carrier roll 36, or by a vacuum from the liner side. The combined liner and flute to flute structure 25 is transported via section 41 to the next processing station.

The transport section 41 may be straight or curved in shape, and if curved, the curve will be arranged to utilise tension forces in the liner to apply gentle pressure to the glue bond. A change in radius will achieve further beneficial bond development.

An automatic splicer may be utilised with each medium coming from roll stands 5 and 8 with the liner coming from roll stand 4.

Figure 4:
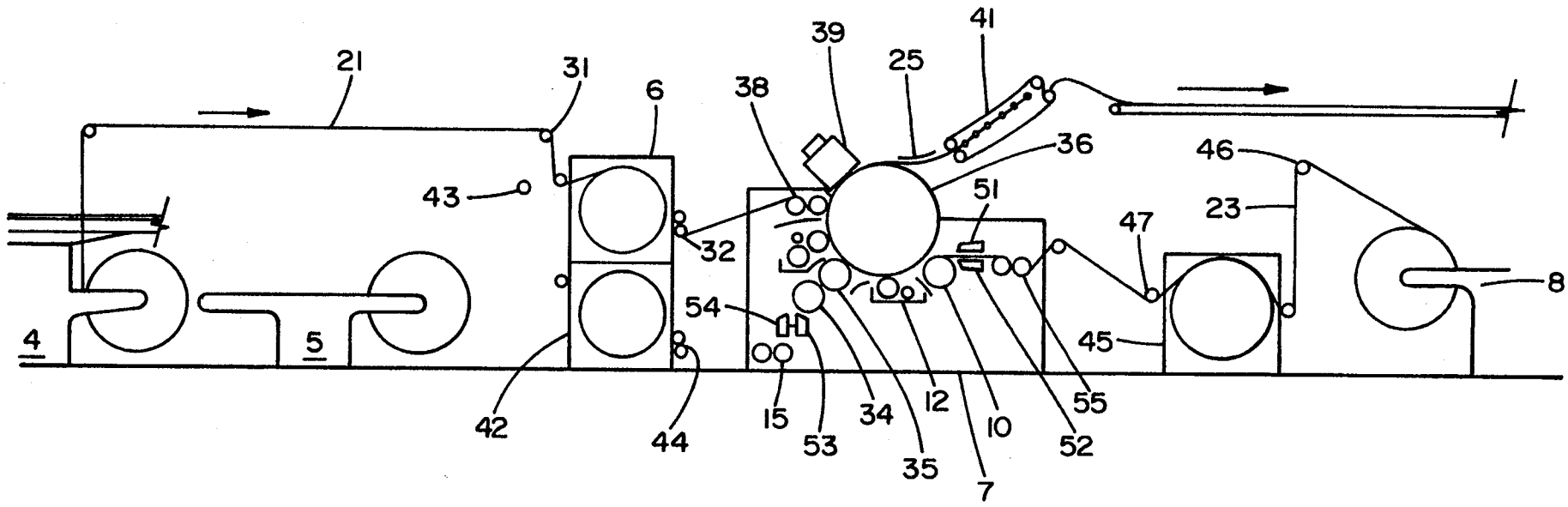
FIG. 4 shows the modified unit of this invention when used to make conventional single faced corrugated board.

As shown in FIG. 4 the modified unit of this invention can also be used to make an improved form of conventional single faced corrugated board.

This is achieved by ceasing to feed the corrugating medium 22 to the corrugating rolls 34 and 35 and also ceasing to apply glue at glue station 12 while continuing application at glue station 37 to corrugated medium 23. In this case the glue station 37 is moved towards the carrier roll 36 to contact the thinner conventional corrugated sheet.

Figure 5:
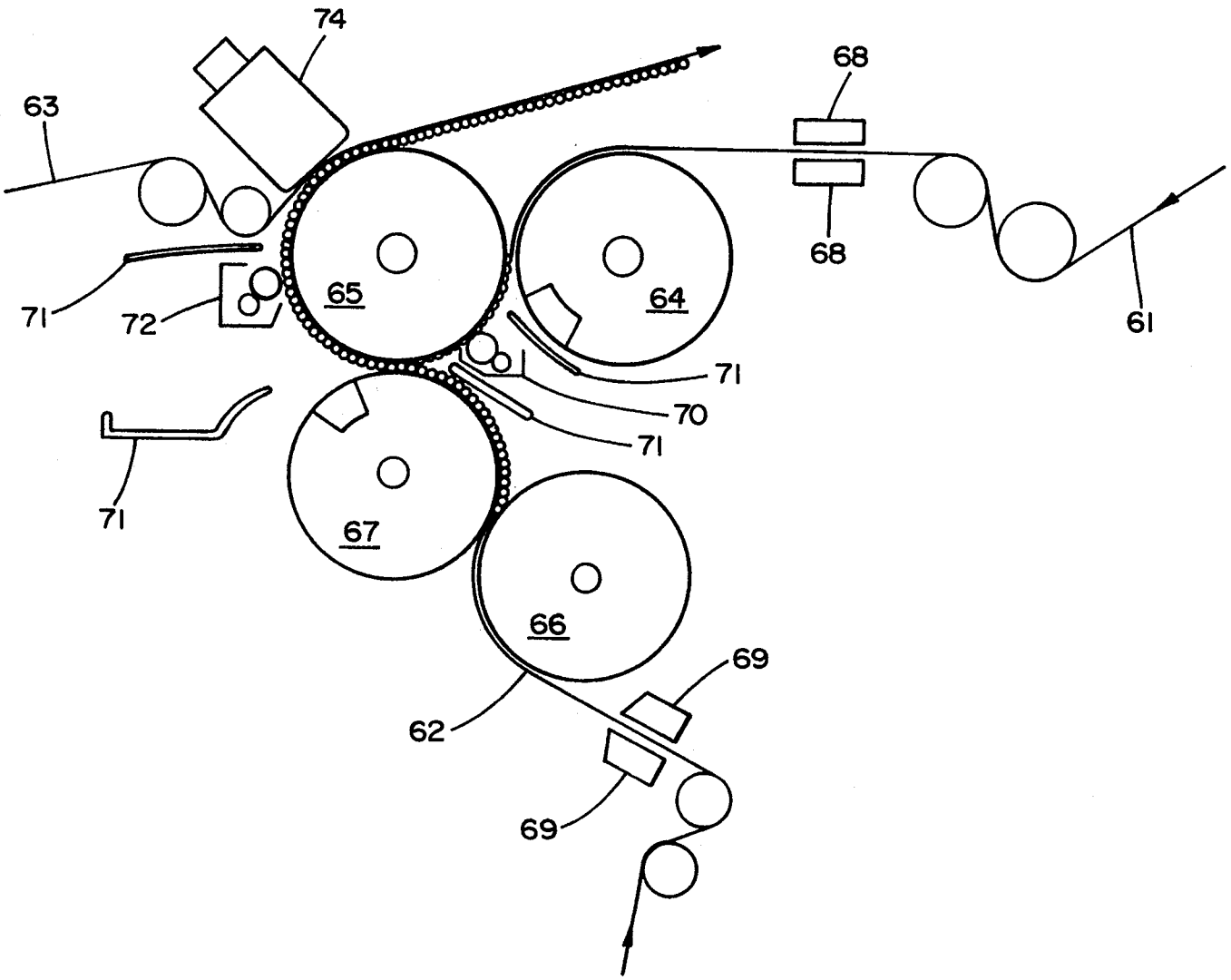
FIG. 5 is a view similar to that of FIG. 3 wherein a carrier roll of the same size as the corrugating rolls is used.

FIG. 5 shows an alternative embodiment in which the carrier roll and the corrugating rolls are of equivalent diameters e.g. 460 mm or 600 mm. The first medium 61 is drawn past steam boxes 68 over the corrugating roll 64 where it is fluted by the intermeshing of rolls 64 and 65. The fluted medium 61 is blown off roll 64 by positive pressure and is retained on the surface of roll 65. Adhesive is applied at glue station 70. The second medium 62 is drawn past steam box 69 and between the corrugating rolls 66 and 67. Fluted medium 62 is carried on roll 67 until its flute peaks contact those of medium 61. The medium 62 is blown off roll 67 by positive pressure and the bonded mediums are retained on roll 65. Adhesive is applied to the outer flute peaks at station 72 and the liner 63 is then bonded to the mediums with the assistance of the energy applicator 74. Heat shields 71 protect the glue stations 70 and 72 from the heat emanating from rollers 64 and 67 which are heated rolls.

From the above it can be seen that the production of board structures with flute tip to flute tip bonding can be achieved with the construction of new machinery as described here or by modification of existing machinery as described elsewhere.

As from the above it can be seen that of conventional broad structures with improved appearance can be produced by way of non pressure bonding technique.

The claims defining the invention are as follows:

1. A single face corrugated board making apparatus capable of forming corrugated boards having two fluted mediums bonded together at the flute tips comprising:

(a) mill roll stands for two mediums and one liner;

(b) a carrier roll fluted to support a first fluted medium;

(c) a single corrugating roll of diameter no larger than the carrier roll engaging with the carrier roll to corrugate the first fluted medium;

(d) a pair of corrugating rolls of diameter no larger than the carrier roll adapted to produce a second fluted medium said pair being located and driven relative to the carrier roll to enable the first and second fluted mediums to be brought into flute tip to flute tip contact and to be conveyed by the carrier roll, the axes of the corrugating rolls not lying in a plane common with the single corrugating roll or the carrier roll;

(e) a first adhesive application station to apply adhesive to one of said fluted mediums prior to the flute tips of the said first and second fluted mediums coming into contact (f) a second adhesive application station to apply adhesive to the exposed flute tips of the bonded mediums or to a liner board;

(g) a liner applicator roll located adjacent to said carrier roll downstream of said second adhesive applicator positioned to lead a liner board into contact with said bonded fluted mediums without application of pressure;

(h) an energy radiator unit located adjacent said carrier roll downstream of said liner applicator to accelerate curing of the adhesive bond between the liner and the mediums;

(i) the diameter of said carrier roll and the positioning of said pair of corrugating rolls being arranged to ensure there is sufficient remaining circumference on said carrier roll to enable the fluted mediums to be retained until after they have passed the curing zone of the said energy radiator.

2. A corrugated board making apparatus as claimed in claim 1 wherein the carrier roll is larger in diameter than the single and pair of corrugating rolls.

* * * * *